US008123661B2

(12) United States Patent
Beyzavi-Armani

(10) Patent No.: US 8,123,661 B2
(45) Date of Patent: Feb. 28, 2012

(54) PORTABLE ISOMETRIC EXERCISE DEVICE AND METHOD

(75) Inventor: M. Armin Beyzavi-Armani, Floersheim am Main (DE); Mariam Beyzavi, legal representative, Floersheim am Main (DE)

(73) Assignee: Armin Armani, Gruenwald (DE)

( * ) Notice: Subject to any disclaimer, the term of this patent is extended or adjusted under 35 U.S.C. 154(b) by 0 days.

(21) Appl. No.: 13/269,775

(22) Filed: Oct. 10, 2011

(65) Prior Publication Data

US 2012/0028760 A1 Feb. 2, 2012

Related U.S. Application Data

(60) Division of application No. 12/604,184, filed on Oct. 22, 2009, now Pat. No. 8,033,958, which is a continuation of application No. 11/786,938, filed on Apr. 13, 2007, now Pat. No. 7,608,016.

(51) Int. Cl.
*A63B 71/00* (2006.01)

(52) U.S. Cl. ..... 482/8; 482/44; 482/91; 482/92; 482/900

(58) Field of Classification Search ..... 482/1–9, 482/44–50, 91, 92, 110, 121, 122, 900–902; 434/247

See application file for complete search history.

(56) References Cited

U.S. PATENT DOCUMENTS

| | | | | |
|---|---|---|---|---|
| 4,557,480 | A | 12/1985 | Dudley | |
| 4,778,175 | A | 10/1988 | Wucherpfennig | |
| D343,881 | S | 2/1994 | Wilson | |
| 5,486,149 | A | 1/1996 | Smith | |
| 5,489,251 | A | 2/1996 | Robles, Jr. | |
| 5,738,611 | A | 4/1998 | Ehrenfried | |
| 6,022,302 | A | 2/2000 | McBride | |
| 6,123,652 | A | 9/2000 | Perleberg-Kolbel | |
| 6,149,559 | A | 11/2000 | Mackey | |
| 6,238,324 | B1 | 5/2001 | MacMillan | |
| 6,536,966 | B1 | 3/2003 | Butler | |
| 6,672,995 | B2 | 1/2004 | Baltodano | |
| 6,913,559 | B2 * | 7/2005 | Smith | 482/4 |
| 7,175,575 | B1 | 2/2007 | Dantolen | |
| 7,465,258 | B1 | 12/2008 | Motrorano | |
| 7,699,755 | B2 * | 4/2010 | Feldman et al. | 482/8 |
| 7,789,801 | B2 * | 9/2010 | Stearns et al. | 482/8 |
| 2002/0086779 | A1 | 7/2002 | Wilkinson | |
| 2003/0134728 | A1 | 7/2003 | Wu | |
| 2003/0211920 | A1 | 11/2003 | Mandel | |
| 2005/0233875 | A1 | 10/2005 | Clarke | |

* cited by examiner

*Primary Examiner* — Glenn Richman
(74) *Attorney, Agent, or Firm* — Jeffer Mangels Butler & Mitchell LLP

(57) ABSTRACT

The present invention is a portable isometric exercise device with resistance generated by a spring force including an electronic light or sound indicator to signal that a constant force level is being maintained. When a force is applied to the spring and a desired level of resistance is achieved, a continuous signal will be generated to advise the user that the isometric force exercise is being maintained. If the force is reduced, the signal will terminate to advise the user that the user has not maintained the required level of resistance.

10 Claims, 5 Drawing Sheets

PORTABLE ISOMETRIC EXERCISE DEVICE AND METHOD

This application is a divisional of U.S. patent application Ser. No. 12/604,184, filed Oct. 22, 2009, which is a continuation of U.S. patent application Ser. No. 11/786,938, filed Apr. 13, 2007, now U.S. Pat. No. 7,608,016, the entireties of which are incorporated herein by reference.

BACKGROUND OF THE INVENTION

1. Field of the Invention

The present invention is related to the field of exercise devices which provide an isometric exercise through a fixed resistance.

2. Description of the Prior Art

The following 10 patents and published patent applications are the closest prior art references which are related to the present invention.

1. U.S. Pat. No. 4,557,480 issued to Edmond R. Dudley on Dec. 10, 1985 for "Portable Exercise Device" (hereafter the "Dudley Patent");

2. U.S. Design Pat. No. Des. 343,881 issued to Andy S. Wilson on Feb. 1, 1994 for "Isometric Exerciser" (hereafter the "Wilson Design Patent");

3. U.S. Pat. No. 5,486,149 issued to Fred T. Smith et al. on Jan. 23, 1996 for "Friction Resistance Exercise Device" (hereafter the "Smith Patent");

4. U.S. Pat. No. 5,489,251 issued to Sherman U. Robles, Jr. on Feb. 6, 1996 for "Exercise Device" (hereafter the "Robles Patent");

5. U.S. Pat. No. 6,123,652 issued to Renate Perleberg-Kolbel on Sep. 26, 2000 for "Levered Resilient Strength Training Apparatus" (hereafter the "Perleberg-Kolbel Patent");

6. U.S. Pat. No. 6,149,559 issued to Teri R. Mackey on Nov. 21, 2000 for "Variable Resistance Exercise Device" (hereafter the "Mackey Patent");

7. U.S. Pat. No. 6,238,324 issued to Gordan A. MacMillan on May 29, 2001 for "Elastic Exerciser System" (hereafter the "MacMillan Patent");

8. United States Published Patent Application No. 2002/0086779 issued to William T. Wilkinson on Jul. 4, 2002 for "Resistance Devices, Total-Body Exercise Machines Outfitted Therewith, And Exercise Methods Using Such Devices And Machines" (hereafter the "Wilkinson Published Patent Application");

9. United States Published Patent Application No. 2003/0134728 issued to Shen Yi Wu on Jul. 17, 2003 for "Exercise Machine" (hereafter the "Wu Published Patent Application");

10. United States Published Patent Application No. 2005/0233875 issued to Raymond Clarke et al. on Oct. 20, 2005 for "Office Gym Exercise Kit" (hereafter the "Clarke Published Patent Application").

The Dudley Patent is a portable exercise device. Specifically, there is a take up reel 14 which has a spring mechanism which causes it to unrewind in the counterclockwise direction and there is a cord 18 which is wound on the reel and extends through a pair of wedges 22 and 23 and out of the wedges so that the cord can be attached to an exercise mechanism such as a bar 36 or a leg strap 37. The resistance is changed by having a frictional engagement between the two wedges 22 and 23 adjusted so that they can more tightly compress the cord to cause the resistance to be greater.

The Wilson Patent is described as an isometric exerciser but it is a design patent. There appears to be some resistance mechanism within the housing from which two straps extend to special hand grips.

The Smith Patent discloses a concept of having an adjustable exercise apparatus wherein the amount of resistance is varied by rotating a dial 54 which has an annular opening 55. Teeth 56 are disposed around the annular opening 55. The teeth mesh with teeth on the outer periphery of a collar 60. The collar 60 is provided with a threaded opening 62 which meshes with the threaded periphery 64 of the shaft 66. The shaft 66 extends through an opening in the bearing 44 to the opposite surface of the casing 12. The shaft 66 has a head 70 at its opposite end with the head resting against the flange 72 on the bearing. The Patent further discloses "When an individual desires to use the exercise apparatus 10, such individual disposes the loop 28 around the post 29 (FIG. 1) and disposes his or her hand or foot in the loop 36 in the cable 32. The individual then pulls the cable 32 outwardly from the casing. This causes the fan blades 39 to rotate and the helical spring 38 to become constrained. The one-way clutch 42 rotates with the fan blades 39 and drives the disc 46 against the friction force imposed by the bearing liners 52. The force imposed by the bearing liners 52 against the disc 46 remains substantially constant throughout the rotation of the disc. When the cable 32 is released, the constraint of the spring 38 produces a rotation of the one-way clutch 42 and the fan blades 39 and the sleeve 34 in a direction to release the constraint on the spring. However, the clutch 42 is decoupled from the bearing 44 so that the bearing and the disc 46 do not rotate. The cable 32 becomes wound uniformly on the periphery of the sleeve 34 as the sleeve rotates, as indicated schematically in FIG. 8. Successive loops are then provided in a successive layer in the space between successive pairs of the first loops". "The magnitude of the friction force imposed by the bearing liners 52 against the disc 46 during the rotation of the disc may be adjusted by rotating the dial 54 (FIGS. 3, 4 and 7). This rotation causes the shaft 66 to rotate so as to vary the force imposed by the head 70 on the shaft against the flange 72 on the bearing 44. Since the bearing 44 is coupled to the disc 46, the force exerted by the disc against the bearing liners 52 is correspondingly varied." Therefore, this device shows a means for varying the resistance.

The Robles Patent is an exercise device for the foot and discloses a harness 12 placed about a foot and a second harness 18 placed about the thigh so that the lower calf muscles can be exercised. The adjustment mechanism to adjust the tension is illustrated in FIG. 4. The tension mechanism consists of a spring 58 which is retained between end spring plate 62 and movable plate 64 which is attached to an adjustable rotating rod 72 which can be rotated by a handle. As the rod is rotated in one direction, the plate causes the spring to compress greater and as the rod is rotated in the other direction, the plate 64 moves away from plate 62 to extend the spring to a larger amount of spring force to increase the compression force of the spring. Therefore, this patent discloses the concept of having the spring mechanism adjusted by an adjusting mechanism such as a rotating rod that increases the length or the length of the spring to increase or decrease the compression force of the spring.

The Perleberg-Kolbel Patent embodies the concept of having three springs within bores in the housing and a lever mechanism which can move within a slot 15 within the housing so that the spring force can be varied as the pulling mechanism on the housing is causing a resistance force for exercise. Specifically, as disclosed in the patent, "turning now in detail to the drawings, FIG. 1 shows an upper portion 2 of the housing 2*a* of the apparatus 1. This has a maximum force indicator element 3 which is contacted by outermost end 4*c* bent through approximately 90°, of a lever 4, shown in FIG. 2. End 4*c* is at the power arm end 4*e* which is displaced when a pulling force is exerted around the power arm end 4*e* of the one-armed lever. The pulling or holding loop 6 is retained in a groove 8 in the lower portion 9 of the housing by means of a cross member 7. A longitudinal central plane divides the housing into portions 2 and 9. FIG. 2 and FIG. 4 show the lever 4 as being a rod profile of one continuous arm with narrow cross section and being bent into U-shape with a small radius of curvature. Thus, the arms 4*a* and 4*b* bear against one another and are jointly engaged by the pulling loop 5. As a result, although the rod profile used has a narrow cross section, the force of resistance of the lever is high enough for the transmission of the exerted pulling forces onto the helical compression springs 10, 11 and 12. This occurs at the working arm end 4*d* of the lever. The springs are disposed in bores 13 of a block-shaped spring housing 14 and can be loaded in the downward compression direction by the lever 4. This downward direction is the same as that shown by the arrow of force K. The lever bears via its work arm 4*d* against the free ends 10*a*, 11*a*, 12*a* of the helical springs extending out of the bores 13. A slot-shaped grove 15 of the spring housing acts as a space for the guidance and movement of the lever when a force K is exerted onto the power arm end 4*e* of the lever."

The Mackey Patent is a variable resistance exercise device which basically has a mechanism by which the string which is attached to a flexible reel can be incorporated into a strap that is worn around the waist or a leg as shown in the figures so that the resistance can be pulled with the leg or the arm with the mechanism attached to a wall as shown in FIG. 6. With respect to the variable resistance mechanism of this invention, referring to FIG. 8, a spring wheel 14 causes cable 4 to retract onto spool 16 and 18. A flexible spring plate 28 is pushed on by the threaded knob 20 so that the further the knob is turned clockwise, the more resistance is put on the top surface 26 of spool 16 and 18 thereby making it harder for the user to pull on. Therefore, the resistance mechanism in this case is varied by having the plate 28 compress further against the spring assembly to therefore cause the spring to be more compressed and therefore, cause the resistance to increase.

The MacMillan Patent is an elastic exerciser system, which consists of a multiplicity of elastic loads such as 10, 11, 12 and 13 shown in FIG. 2 which can be coupled together and each having a ring extending therefrom to which handles 25 and 27 can be attached so that the loads can be used to pull on either by having a pair of hands extending through the rings or a pair of feet or ankles extending through the rings to create a tension.

The Wilkinson Published Patent Application discloses a retraction wheel mechanism as shown in FIGS. 2*a* and 2*b* attached to the cord 217 which is in turn attached to the mechanism 219 which can be wrapped around an arm or a leg. The retraction mechanism on the cable 217 is illustrated in FIG. 2*a* consists of a spring 206 which causes the reel to automatically rewind back onto the spool. Other resistance in addition to the spring is such as caliper arms 211 and 212 which increase the resistance.

The Wu Published Patent Application is also a portable exercise machine. It contains a cable or rope assembly which is rewound into the housing by a spring mechanism 23. In this case, it is a spiral spring that causes the rope to rewind back into the casing after it is extended out by a pulling action by an arm or a leg pulling on the handle assembly 611. In this case for purposes of the retraction mechanism on one side of the wheel 20, there is a spiral spring 23 which is installed with a unidirectional bearing 24. The unidirectional bearing 24 is installed with a friction means. In this embodiment, the friction means is a friction wheel 30. An outer periphery of the friction wheel 30 is enclosed by a friction strip 31. The contact between the friction strip 31 and the friction wheel 30 is controlled by an adjust device 40. On this embodiment, the adjust device 40 if fixed to the body 10 by a fixing frame 41. The fixing frame 41 is an approximate U shaped plate. The fixing frame 41 has a penetrated hole through hole 411. An approximate rectangular adjust block 42 is installed in the fixing frame 41. The adjust block 42 has a threaded hole 421. The through hole 411 of the fixing frame 41 is passed through by a stud 43. The stud 43 is received in the long groove 105 of the body 10. One end of the stud 43 is installed with a button 431. Another end of the stud 43 has a threaded section 432. The threaded section 432 is screwed to a screw hole 421 for the fixing frame 41. One end of the friction strip 31 is firmly secured to the adjust block 42. By rotating the button 431 to rotate the stud 43, the adjust block 42 may move upwards or downwards in the fixing frame 41 so as not to rotate. Therefore, the friction force between the friction strip 31 and the friction wheel 30 is adjusted.

Finally, the Clarke Published Patent Application is a portable exercise gym. Within the device, a resistance means consists of a flexible fabric with a generally rectangular portion as shown in FIG. 20 with a multiplicity of apertures 30. It consists of a bunch of retainers that extend through the flexible fabric that creates the resistance.

There is a significant need for an improved isometric exercise device which is simple, portable and provides features not found in prior art exercise devices which provide an isometric exercise.

SUMMARY OF THE INVENTION

The present invention is a portable isometric exercise device with resistance generated by a spring force including an electronic light or sound indicator to signal that a constant force level is being maintained, comprising a device body and other necessary peripheral parts such as a first and second upper grips linked with a cable or string, and a lower grip. The device body is comprised of an isometric spring force selector incorporated with an electronic light or sound indicator with two electrodes, an interior elongated coil spring which is incorporated with a "U" shaped spring force selection member having top transverse sections which are placed on a top end of the spring wherein one transverse section is further extended to be placed inside of a middle channel of the isometric spring force selector. The device further includes a top cover and a device body bottom cover which is installed with a pulley, wherein the isometric spring force selector and the coil spring are placed inside of the device body.

The device body is connected to the peripheral parts, with the cable or string at the middle position slidably connected into an interior channel of the pulley, and the lower grip is looped or chained onto a bottom end of the "U" shaped force selection member. The device works in such way that a user first selects a level of the spring force for the isometric exercise through plugging the electronic light or sound indicator having two electrodes into two paired openings in a row selected among a multiplicity of paired openings positioned in a pattern having two columns and multiple rows which transversely penetrate through the isometric spring force selector. The user then affixes the lower grip at a fixed position such as the ground by inserting the user's foot through the grip. The user starts to exercise by using his hands to pull on the first and second upper grips. This results in pulling the pulley as well as the device body upward. Therefore, the coil spring installed inside of the device body is compressed by a pulling force from the user. This makes one top transverse section of the "U" shaped force selection member which is placed into the middle channel of the isometric spring force selector slidably move downwardly to electrically contact both two electrodes of the electronic light or sound indicator which are plugged into the pair openings of the isometric force selector. The electrical contact activates an integrated electronic device placed inside of the indicator which drives its electronic light or sound component to send a visual or audible signal. Therefore the signal advises the user that a force output from the user's body muscles balance the level of the spring force which the user has chosen so that a given level of isometric resistance is maintained. If the resistance is lessened, then the contact is broken and the visual or audible signal terminated so the user knows that the isometric level of resistance has not been maintained. The user has multiple selections of the spring force levels for the isometric resistance since the isometric spring force selector is comprised of multiple paired openings which isometrically correspond to multiple force levels of the spring when it is compressed by the user in the exercise.

It has been discovered, according to the present invention, that if a portable isometric exercise device has a device body which is comprised of an isometric spring force selector having multiple paired openings positioned to align the longitudinal isometric spring force selector, wherein the multiplicity of paired openings correspond to a multiplicity of different isometric resistance forces created from a multiplicity of spring force levels of a coil spring when it is compressed by a user in the exercise, then the user can choose any paired openings on the isometric spring force selector to select a specific level of the isometric resistance spring forces for the user's exercise.

It has also been discovered, according to the present invention, that if a portable isometric exercise device has a body comprising an elongated coil spring which is inside the body and is incorporated with a "U" shaped spring force selection member having top transverse members which are placed on the top end of a coil spring, wherein one transverse top member is extended to be placed inside of a middle flat channel with opened sides so that the isometric spring force selector can be slidably moved downwardly aligning the longitudinal direction of the isometric spring force selector when the coil spring is compressed by a user in exercise, then the position of the top transverse member of the "U" shaped spring force selection member which is proportional to a particular force level of the coil spring can be used as an indication that the user outputs a muscle force which reaches the level of the spring force.

It has been further discovered, according to the present invention, that if a portable isometric exercise device has a body comprising an elongated coil spring which is inside the body and is incorporated with a "U" shaped spring force selection member having top transverse members which are placed on the top end of the spring, wherein one transverse top member is extended to be placed inside of a middle flat channel with opened sides of the isometric spring force selector so that it can be slidably moved downwardly when the coil spring is compressed by the user in exercise to electrically contact two electrodes of an electronic light or sound indicator which are plugged into two paired openings in a row of the isometric spring force selector, then an integrated electronic device placed inside of the indicator will be activated to drive its electronic light or sound component for outputting light or sound as a signal to advise the user that a given level of isometric resistance force is being maintained and if the force is reduced, the visual or audible signal will be terminated since the electrical contract is broken.

It has been additionally discovered, according to the present invention, that if an additional "U" shaped electrical contacting member comprising a bottom electrically conducting arm is used to embrace a transverse top member of the "U" shaped force selection member, then the bottom electrically conducting arm of the "U" shaped electrically contacting member will provide a better electrical contact to two electrodes of the electronic light or sound indicator for securely generating the alarm so that the user will be informed that his muscle outputs a force which reaches a level of the spring force which is chosen for his exercise.

It is therefore an object of the present invention to provide a portable isometric exercise device having a device body which is comprised of an isometric spring force selector having multiple paired openings positioned to align the longitudinal isometric spring force selector, wherein the multiple paired openings corresponding to multiple isometric resistance spring force levels of a coil spring when it is compressed by a user in the exercise, so that the user can choose any paired openings on the isometric spring force selector to select a specific level of the isometric resistance spring forces for the user's exercise.

It is also an object of the present invention to provide a portable isometric exercise device having a body comprising an elongated coil spring which is inside the body and is incorporated with a "U" shaped spring force selection member having top transverse members which are placed on the top end of the coil spring, wherein one transverse top member is extended to be placed inside of a middle flat channel with opened sides so that the isometric spring force selector can be slidably moved downwardly aligning the longitudinal direction of the isometric spring force selector when the coil spring is compressed by a user in exercise, so that the position of the top transverse member of the "U" shape spring force selection member which is proportional to a particular force level of the coil spring can be used as an indication that the user outputs a muscle force which reaches the level of the desired isometric resistance spring force.

It is an additional object of the present invention to provide a portable isometric exercise device having a body comprising an elongated coil spring which is inside of the body and is incorporated with a "U" shaped spring force selection member having top transverse members which are placed on the top end of the spring, wherein one transverse top member is extended to be placed inside of a middle flat channel with opened sides so that the isometric spring force selector can be slidably moved downwardly when the coil spring is compressed by the user in exercise to electrically contact two electrodes of an electronic light or sound indicator which are plugged into two paired openings in a row of the isometric spring force selector, so that an integrated electronic device placed inside of the indicator will be activated to drive its electronic light or sound component for outputting light or sound as a signal to advise the user that his muscle outputs a force to reach a level of the isometric resistance spring force which is chosen by the user for the user's body work out.

It is a further object of the present invention to provide an additional "U" shaped electrically contacting member comprising a bottom electrically conducting arm which is used to embrace a transverse top member of the "U" shaped force selection member, so that the bottom electrically conducting arm of the "U" shaped electrically contacting member will provide a better electrical contact to two electrodes of the electronic light or sound indicator for securely generating the alarm so that the user will be securely informed that his muscle outputs a force which reaches a level of the'desired isometric resistance spring force which is chosen for the user's exercise.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention is a portable isometric exercise device, comprising an elongated isometric spring force selector having multiple paired openings positioned along its longitudinal direction which are proportional to various isometric levels of spring forces of a coil spring compressed by a user in exercise, the coil spring inside is incorporated with a "U" shaped spring force selection member having a top transverse force selection member which is inserted into a middle flat channel with opened sides of the isometric spring force selector and further slidable inside of the channel, and an electronic light or sound indicator comprising an electronic light or sound component which is plugged into two paired openings in a row of the isometric spring force selector. The device will generate an alarm of light or sound from the indicator when the coil spring is compressed by the user to reduce its length which results in a downwardly sliding movement of the top transverse force selection member to electrically contact two electrodes of the indicator. Therefore the user will be aware that his muscle forces reaches a level of the spring forces that he has chosen through choosing the paired openings of the isometric spring force selector for his body work out.

Figure 1:
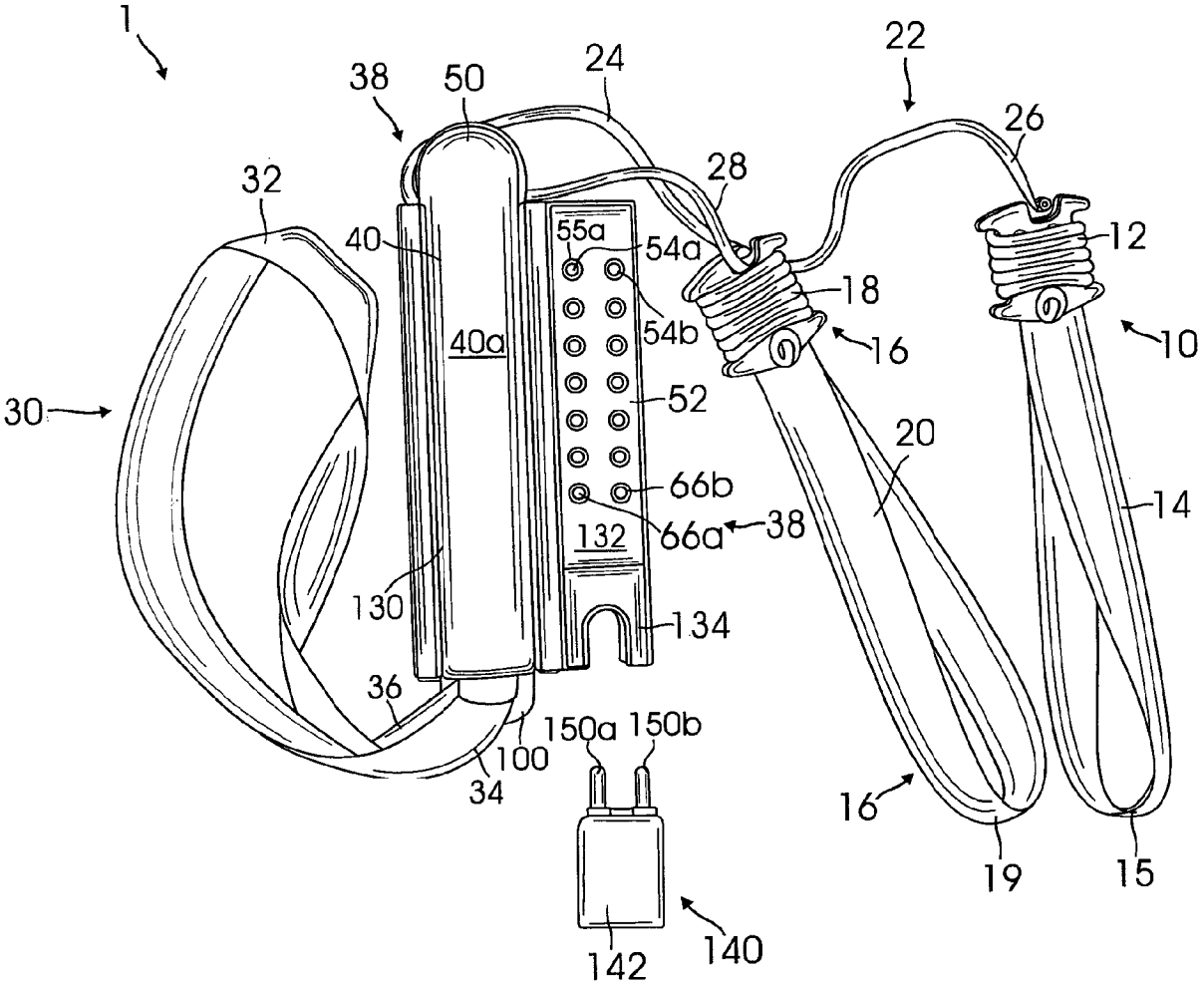
FIG. 1 is a perspective view of the present invention portable isometric exercise device to illustrate components of the device, including a body of the device incorporated with an electronic light or sound indicator, a first and second upper grip linked with a cable or string, and a lower grip, wherein the cable or string and lower grip are separately incorporated within the device body.
Figure 2:
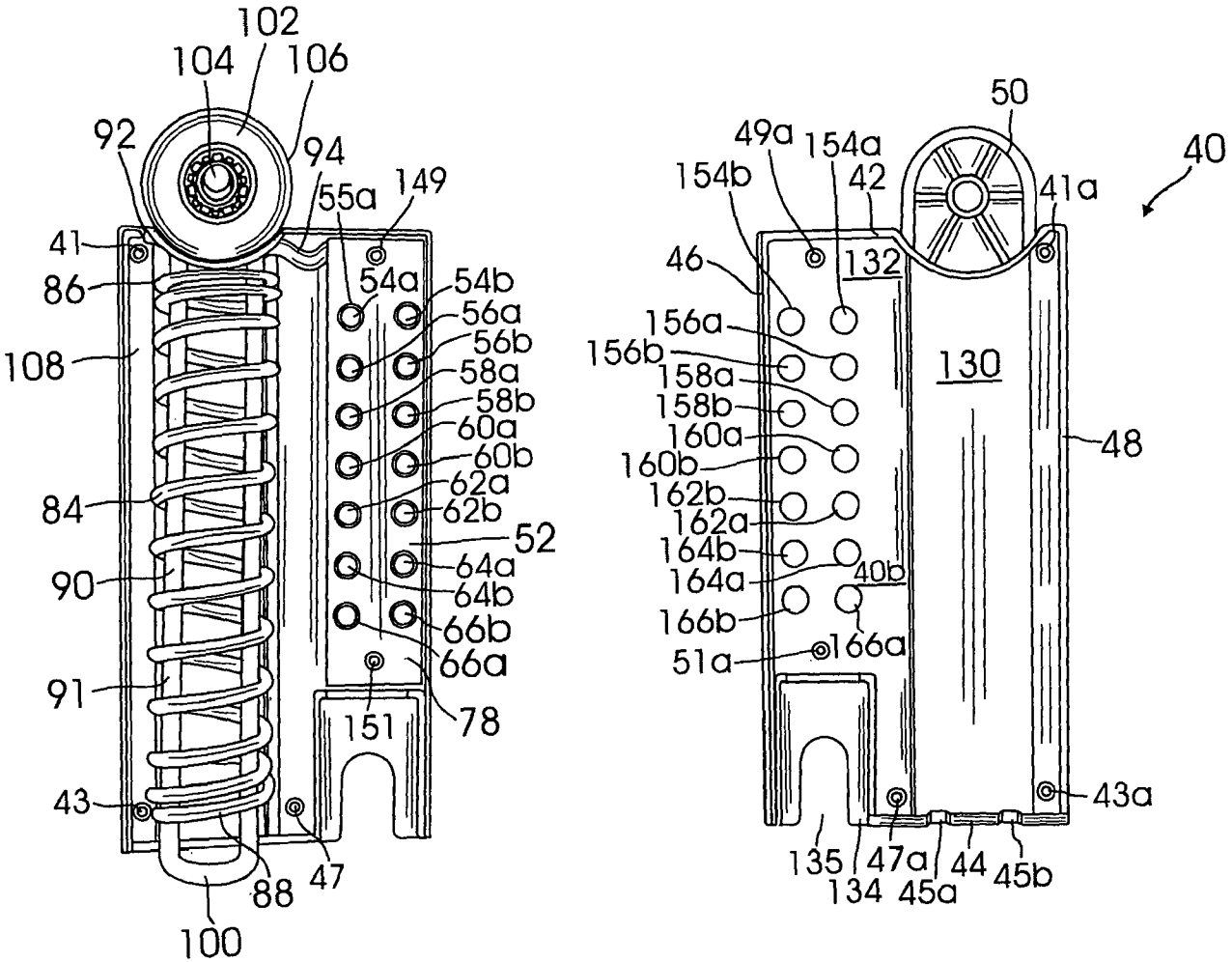
FIG. 2 is a cross-sectional view of the two halves of the device to illustrate the major parts installed inside of the device body including a coil resistance force spring inside incorporated with a "U" shaped spring force selection member, a pulley, and an isometric spring force selector.
Figure 3:
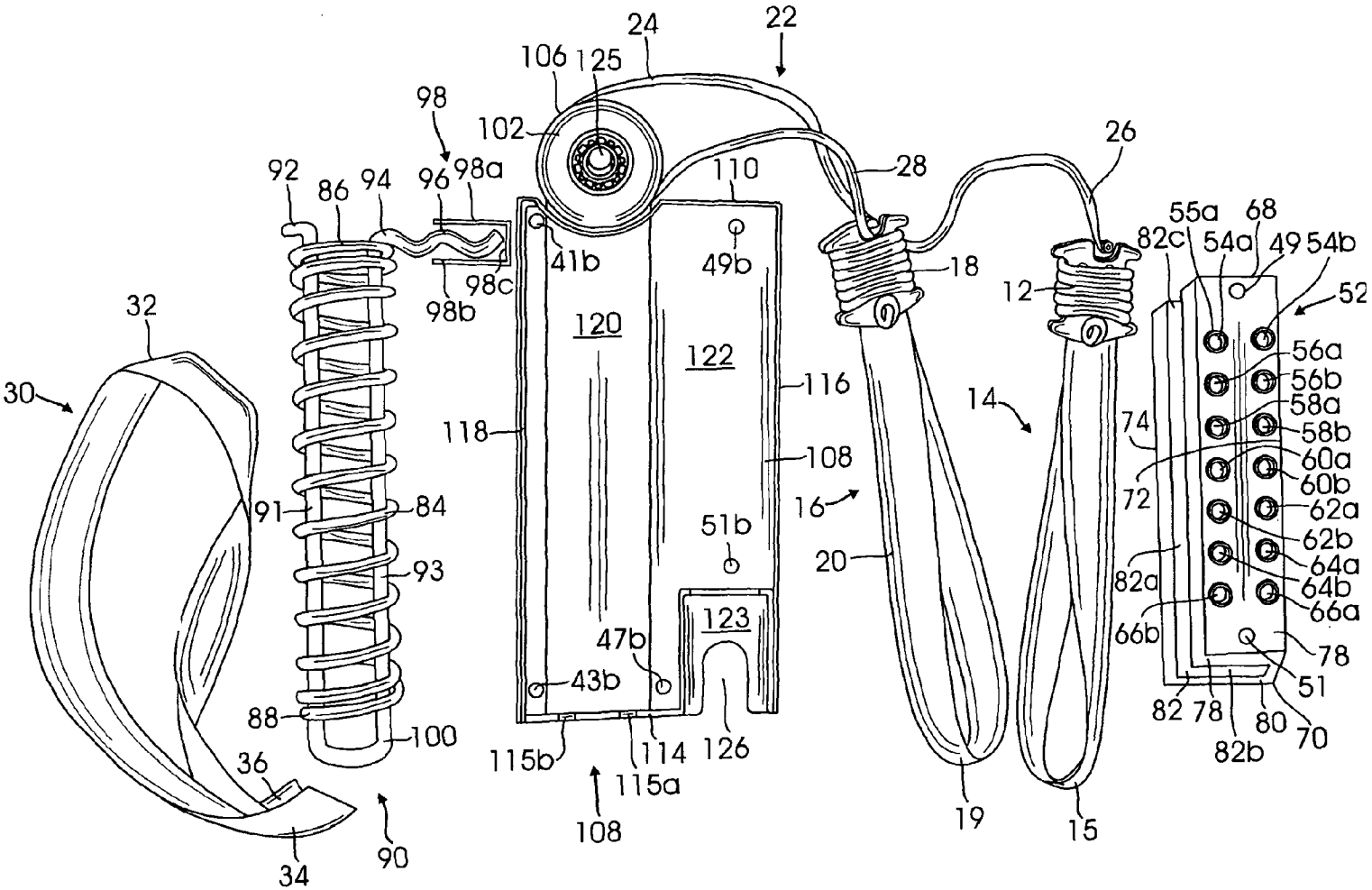
FIG. 3 is a perspective exploded view of the present invention to illustrate the coil resistance force spring inside incorporated with the"U" shaped force selection member, isometric spring force selector, first and second upper grip which are connected to a cable or string, lower grip, and bottom cover incorporated with a pulley which links the cable or string.

Referring to FIGS. 1, 2 and 3, there are illustrated structural components of the present invention portable isometric exercise device 1, comprising a first upper grip 10 and a second upper grip 16, a cable or string 22, a lower grip 30, an electronic light or sound indicator 140 and a body 38 of the device which has its upper and lower sections fastened with multiple fasteners such as screws 41, 43, 47, 149 and 151.

The first and second upper grips 10 and 16 are identical as further illustrated in FIG. 3. The first upper grip 10 is comprised of a retaining member 12 which at one end is connected to a first end 26 of a cable or string 22, and at an opposite end is affixed to both ends of a strap 14 to form a loop having a looped end 15. Similarly, the second upper grip 16 has a retaining member 18 which at one end is connected to the second end 28 of the cable or string 22 and at its opposite end is connected to both ends of strap 20 to form a loop having a looped end 19. The cable or string 22 is illustrated at its middle portion 24 to slidably retained in an interior channel 106 of a pulley 102 which is installed onto a bottom cover 108 of the device body 38. Therefore, the cable or string 22 can be rotatably moved along with a rotation of the pulley 102 if the first or second upper grip 10 and 16 is pulled.

The exercise device body 38 as illustrated in FIGS. 1 through 3 comprises a top cover 40 and a bottom cover 108, an isometric spring force selector 52, a coil resistance force spring 84 positioned between top cover 40 and bottom cover 108, and a "U" shaped spring force selection member 90, extending within the coil resistance force spring 84. Also included is a separate electronic light or sound indicator 140.

The resistance force spring 84 is an elongated coil having a top end 86 and a bottom end 88. The majority of the "U" shaped spring force selection member 90 is positioned inside coil force spring 84. The "U" shaped spring force selection member 90 as illustrated in FIG. 3 comprises a "U" shaped bottom connecting member 100 connected to a left longitudinal bar 91 terminating in a left top short transverse end 92 and a right longitudinal bar 93 having a transverse right top end 94 which continues to a transverse force selection member 96. In a preferred embodiment, the force selection member 96 is a short section of the spring rod having a wavy shape.

It will be appreciated that the left short transverse top end 92 and the transverse force selection member 96 at the right top end 94 lock the "U" shaped spring force selection member 90 into the coil spring 84 at its top end 86.

As further illustrated in FIG. 3, an additional "U" shaped electrical contacting member 98 is used to embrace the transverse force selection member 96. The electrical contacting member 98 comprises a top horizontal arm 98*a* connected to a connecting portion 98*c* which in turn is connected to a bottom horizontal arm 98*b*. Top horizontal arm 98*a* is parallel to bottom horizontal arm 98*b* and are aligned with transverse force selection member 96. The "U" shaped spring force selection member 90 is installed into to the coil spring 84, wherein the right and left longitudinal bars 91 and 93 are retained inside of the spring, and the right top end 94 is connected with the transverse force selection member 96 with the left transverse top end 92 and right transverse top end 94 placed on the spring top end 86. The "U" shaped bottom connecting member 100 extends out of the bottom end 88 of the coil spring 84.

The isometric spring force selector 52 is an elongated rectangular piece having a top end 68 and a bottom end 70, and a right side 72 and a left side 74. Referring to FIG. 3, the isometric force selector 52 is illustrated in detail to comprise a top flat member 78 and a bottom flat member 80, which surround a middle flat channel 82 between the top and bottom flat members. The middle channel 82 has an opened left side 82*a*, an open bottom end 82*b* and a open top end 82*c*. The transverse force selection member 96 and the electrical contacting member 98 are inserted into the channel 82 and further slidably retained within the channel 82, the transverse force selection member being inserted through the open left side 82*a* of channel 82.

The isometric spring force selector 52 is further comprised of a plurality of paired openings 54*a* and 54*b*, 56*a* and 56*b*, 58*a* and 58*b*, 60*a* and 60*b*, 62*a* and 62*b*, 64*a* and 64*b*, and 66*a* and 66*b*, which are designed to vertically penetrate through the transverse top and bottom flat members 78 and 80, wherein allocation of the openings is followed with a pattern of two columns and seven rows. Two paired openings 54*a* and 54*b* in the first row are placed closest to the top end side 68 of the isometric spring force selector 52. The next two paired openings 56*a* and 56*b* in the second row are placed lower than the openings 54*a* and 54*b* in the first row. Following this order, all fourteen openings are arranged which openings 54*a*, 56*a*, 58*a*, 60*a*, 62*a*, 64*a* and 66*a* are in the left column, and the openings 54*b*, 56*b*, 58*b*, 60*b*, 62*b*, 64*b* and 66*b* are in the right column. In addition, a top and bottom screw hole 49 and 51 are placed adjacent to the respective top and bottom end side 68 and 70 for fastening the isometric spring force selector 52 through using the fasteners such as screws 149 and 151 shown in FIG. 2. The top cover 40 is a generally a rectangular shape having respectively a top, bottom, right and left side rim 42, 44, 46 and 48, comprising an elongated concave left portion 130 and elongated flat right portion 132 attached with a generally rectangular concave small portion 134. The top rim 44 is further comprised of a left round portion and a right straight portion. A round concave addition 50 is coaxially attached to the top side of the concave left portion 130.

As illustrated in FIGS. 1 and 2, the left curved portion 130 of the top cover 40 functions as a half of a housing for the resistance force spring 84 and incorporated "U" shaped spring force selection member 90, when the left curved portion 130 is combined with a counterpart of the bottom cover 108. Therefore, two half round opening 45*a* and 45*b* are arranged on the bottom rim 44 and are symmetrically aligned with the longitudinal axis of the left concave portion 130, which serve as half of the opening for retaining the respective right and left longitudinal bars 93 and 91. As further illustrated, the top round addition 50 is used as a part of a housing for the pulley 102, and the elongated flat right portion 132 is used to partially house the isometric spring force selector 52. It will be appreciated that the bottom concave small rectangular portion 134 also serves as a half housing for the electronic light or sound indicator 140 which can be placed inside of the housing when the present invention exercise device 1 is not in use. In a preferred embodiment, a "U" shaped opening 135 is cut on the half housing 134 for convenience to house the electronic light and/or sound indicator 140.

The top cover 40 on its inner side 40*b* close to the left rim 46 contains a top and bottom cylindrical post 49*a* and 51*a* having a central female threaded hole to match the respective top and bottom opening 49 and 51 of the isometric spring force selector 52 for fastening the device body 38. In addition, there are three additional cylindrical posts on the inner side of the top cover 40, which includes a top one 41*a* and two bottom ones are 43*a* and 47*a* for also for fastening the device body 38.

The top cover 40 is further comprised of a multiplicity of paired openings 154*a* and 154*b*, 156*a* and 156*b*, 158*a* and 158*b*, 160*a* and 160*b*, 162*a* and 162*b*, 164*a* and 164*b*, and 166*a* and 166*b*, which are placed on the right flat portion 132 of the top cover 40, as illustrated in FIG. 2 when viewed from the inner side 40*b* of the top cover. The multiple paired openings are arranged in the same format of two columns and seven rows as the format of the openings on the isometric spring force selector 52, wherein the paired openings 154*a* and 154*b* in the first row which are closest to the top end side rim 42 match the respective paired openings 54*a* and 54*b* on the isometric spring force selector 52. Similarly, each opening on the top cover 40 matches the respective opening on the isometric spring force selector 52. It will be appreciated that the electronic light or sound indicator 140 having two electrodes 150*a* and 150*b* can be plugged into any two paired openings in a row on the isometric spring force selector 52 through the corresponding two paired openings of the top cover 40. In a preferred embodiment, each round opening 54*a* of the isometric spring force selector 52 has an annular rim 55*a* to surround the opening 54*a* shown in FIG. 3, and each round opening 154*a* on the top cover 40 matches the size of the annular rim 55*a*. Therefore, the annular rim 55*a* will be placed to extend through the opening 154*a* when the top cover 40 is placed on the top of the isometric spring force selector 52 for assembling the device body 38.

The bottom cover 108 is generally a mirror image of the top cover 40, which is illustrated through its inner side shown in FIG. 3, having a top, bottom, right and left side rim 110, 114, 116 and 118. It will be appreciated that each of the bottom cover rims matches the respective rim of the top cover, so that the top and bottom cover 40 and 108 can be perfectly combined together. The bottom cover 108 is illustrated to further comprise an elongated convex left portion 120 and elongated flat right portion 122 attached with a generally rectangular convex small portion 123. A round convex addition (not shown) is coaxially attached to the top of the elongated convex left portion 120, wherein a rotation axle 125 is vertically placed at the center of the round convex addition for installation of the pulley 102. FIG. 3 also shows a plurality of the screw holes 41*b*, 43*b*, 47*b*, 49*b* and 51*b* on the bottom cover 108, which matches the respective cylindrical posts 41*a*, 43*a*, 47*a*, 49*a* and 51*a* on the inner side of the top cover 40. It will be appreciated that as illustrated in FIGS. 1 to 3, the left convex portion 120 of the bottom cover 108 provides the other half of the housing for the resistance force spring 84 incorporated with the "U" shaped spring force selection member 90. Therefore two half round openings 115*a* and 115*b* are arranged on the bottom rim 114 symmetrically along with a longitudinal axis of the left convex portion 120. Two half round openings 115*a* and 115*b* functioned as a respective opposite half of the respective round opening for retaining the respective left and right longitudinal bars 93 and 91 of the "U" shaped spring force selection member 90. It will be further appreciated that the top round addition is part of the housing for the pulley 102, and the bottom convex small rectangular portion 123 with a preferred "U" shaped opening 126 also forms a half of the housing for the electronic light or/and sound indicator 140, wherein the above mentioned respective housings are completed when the top and bottom cover 40 and 108 are assembled together with the fastener means such as screws 41, 43, 47, 149 and 151 through the respective screw holes 41*b*, 43*b*, 47*b*, 49*b* and 51*b* of the bottom cover 108 to threadedly connect the respective cylindrical posts 41*a*, 43*a*, 47*a*, 49*a* and 51*a* of the top cover 40.

Referring to FIGS. 1 and 3, there is illustrated lower grip 30 having a strap comprising a first end 34 and a second end 36, and a middle section 32, wherein the first and second ends 34 and 36 of the strap are both looped/chained onto the "U" shaped bottom connecting member 100 of the "U" shaped force selection member 90 to form a loop having a loop end at middle section 32.

Figure 4:
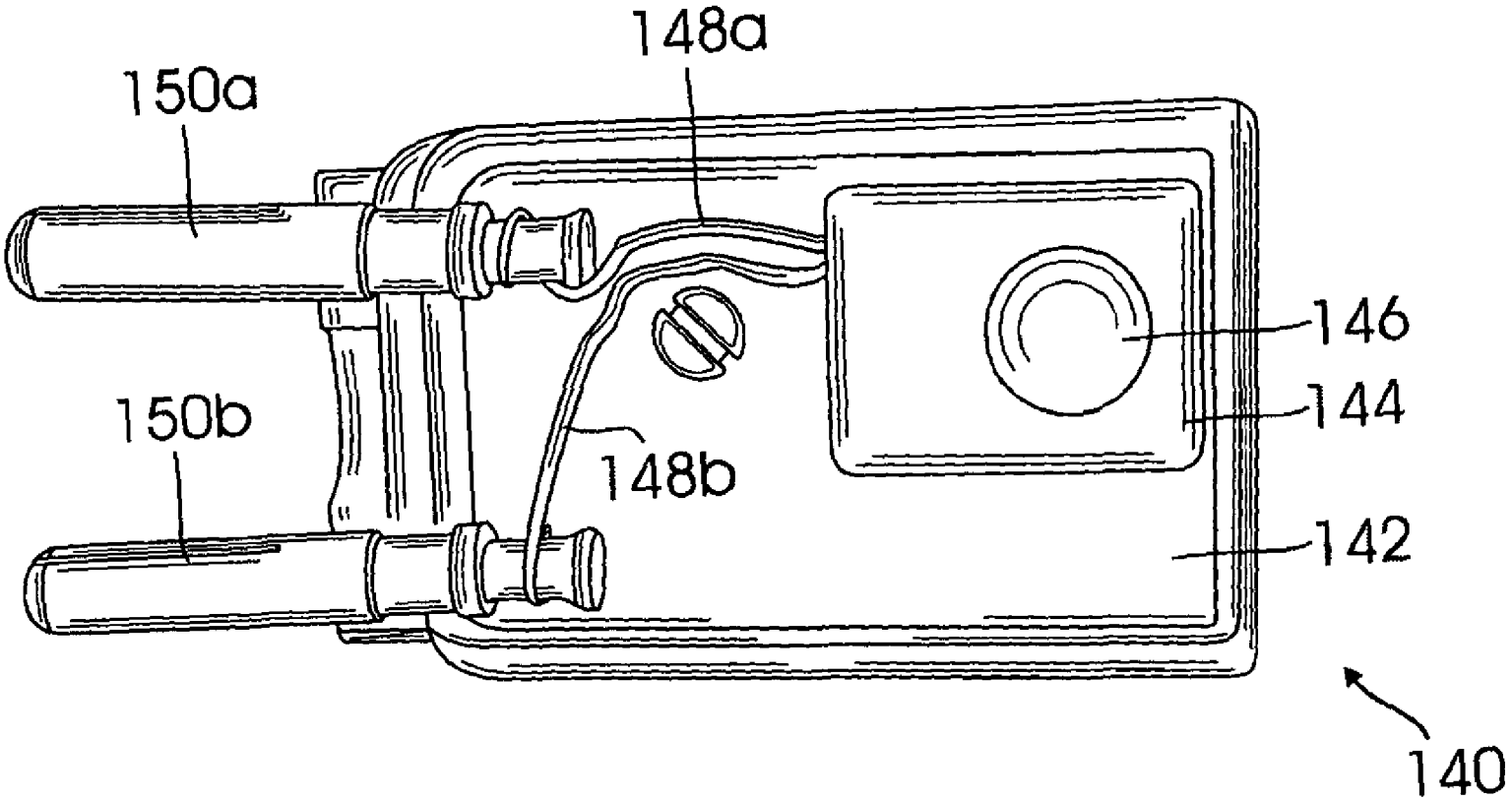
FIG. 4 is a perspective view with a partial cut away view of the electronic light or/and sound indicator.

The electronic light or sound indicator 19 shown in FIG. 4 is comprised of a body 142 with an outer cover. Inside of the body is included a disc battery 146 attached onto an integrated electronic device 144 containing an electronic light component such as an LED, or a standard electronic sound component. The integrated electronic device 144 is electrically connected to a first and second electrode 150*a* and 150*b* through a respective first and second wire 148*a* and 148*b*. It will be appreciated that the integrated electronic device 144 works in such way so that it is in a standby state when the two electrode 150*a* and 150*b* are electrically open. At the standby state, only finite electric current is needed for the electronic integrated device 144 so that the disc battery 146 can work for a long period of time. Once two electrodes 150*a* and 150*b* are changed to an electrically completed circuit state, the integrated electronic device 144 will be activated so that it drives the electronic light or sound component to produce a visual light signal and/or an audible sound which serves as an indicator. However even in the activated state, only a very limited current is needed for the integrated electronic device 144, which makes the battery 146 have a long usable life time.

The device body 38 is assembled in accordance with the illustration of FIGS. 1 to 3. The spring 84 incorporated with the "U" shaped spring force selection member 90 is placed into the housing which is comprised of the concave section 130 of the top cover 40 and convex portion 120 of the bottom cover 108 when the top and bottom covers 40 and 108 are combined together, wherein the top end 86 of the resistance force spring 84 is placed behind but immediately to contact a top inner side of the housing including a part of the top rim 110 and 42 of the respective bottom and top covers 108 and 40. Similarly the bottom end 88 of the force spring 84 is placed above but immediately to contact a bottom inner side of the housing including a part of the bottom rim 44 and 114 of the respective bottom and top covers 108 and 40. The bottom "U" shaped connecting member 100 of the "U" shaped force selection member 90 is placed outside of the spring housing of the device body 38 through two openings, of which one is combined with the respective half round openings 45*a* and 115*a* of the respective top and bottom cover 40 and 108, and the other one is formed from combining the half round openings 45*b* and 115*b*. The isometric spring force selector 52 is placed between the flat longitudinal portions 132 and 122 of the respective top and bottom covers 40 and 108, wherein each opening 54*a* and 54*b* on the isometric spring force selector 52 matches each corresponding opening 154*a* and 154*b* on the top cover 40, and the transverse force selection member 96 of the "U" shaped force selection member 90 is embraced by the "U" shaped electrical contacting member 98 placed inside of the middle flat channel 82 of the isometric spring force selector 52. The body 38 of the device 1 is completely assembled after all the fasteners shown in FIG. 2 are affixed, so that the "U" shaped force selection member 90 is movable along the longitudinal direction of the device body 38.

Figure 5B:
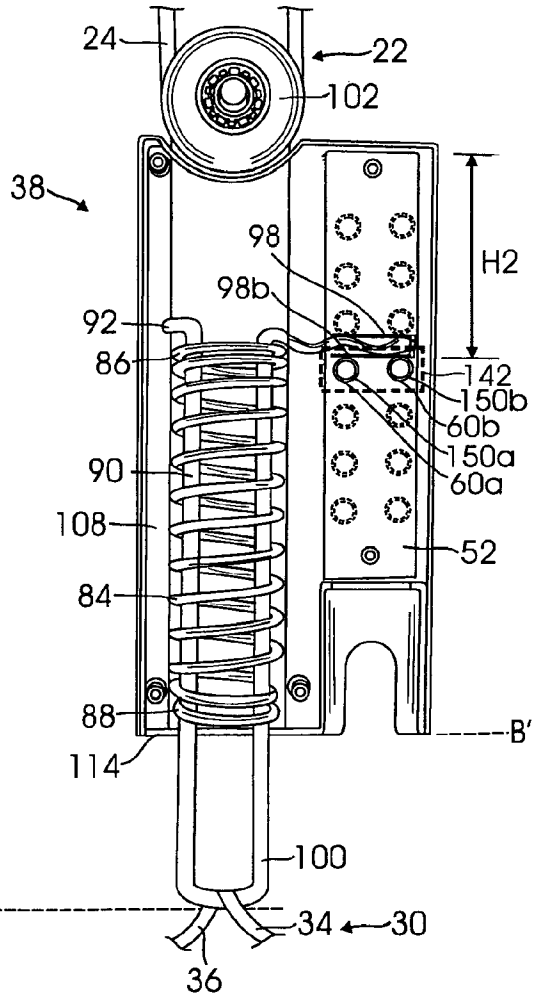
FIG. 5B is a cross-sectional view of the device to illustrate how the present invention works through providing a second example where a pair of openings is selected which is at a lower position of the isometric spring force selector by plugging the electronic light or sound indicator into the openings, which lower position corresponds to a higher level of the spring resistance force in comparison with the selected higher positioned of the openings illustrated in FIG. 5A. The device body is presented for a better illustration wherein the top cover of the device body is removed, the top flat section of the isometric spring force selector is cut away, all unused openings of the isometric spring force selector are in dotted lines as well as the body of the electronic light or sound indicator.
Figure 5A:
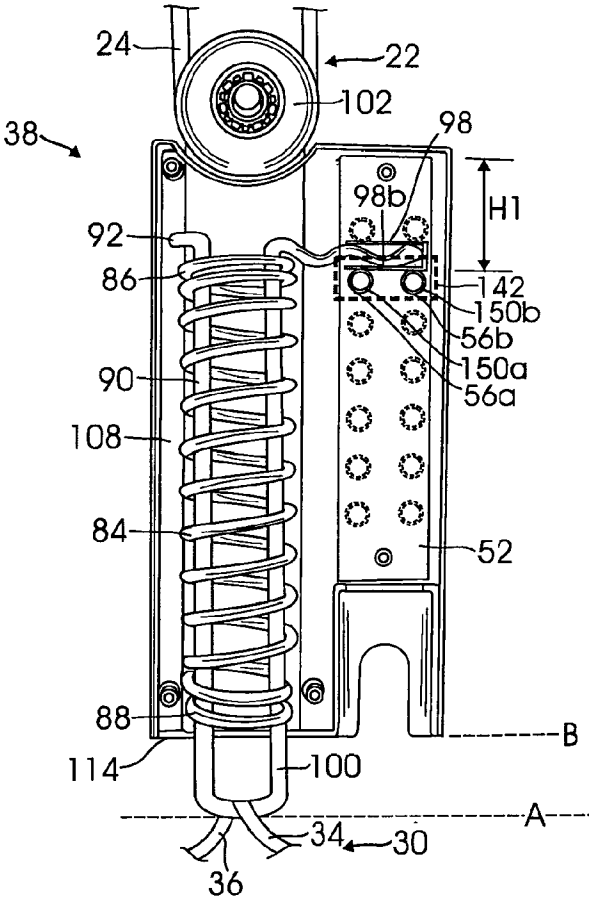
FIG. 5A is a cross-sectional view of the device to illustrate how the present invention works through providing a first example where a pair of openings is selected which is at a higher position of the isometric spring force selector by plugging the electronic light or sound indicator into the openings, which higher position corresponds to a lower level of the spring resistance force. The device body is presented for a better illustration wherein the top cover of the device body is removed, the top flat section of the isometric spring force selector is cut away, all unused openings of the isometric spring force selector are in dotted lines as well as the body of the electronic light or sound indicator.

Referring to FIGS. 5A and 5B now, there is illustrated application of the present invention 1 isometric exercise device, wherein both FIGS. 5A and 5B are perspective cross-sectional views to show part of the invention 1 including a part of the cable or string 22 and lower grip 30, wherein the top cover 40 is removed from the device body 38, and the top flat section 78 of the isometric spring force selector 52 is cut off to better illustrate how the present invention 1 works.

When in use, a user first has to choose a spring force level from which the user prefers to exercise his body muscles for an isometric resistance. To do that the user simply needs to remove the electronic light or/sound indicator 140 stored inside of the housing which is formed from combining the small rectangular curved portions 134 and 123 of the respective top and bottom coves 40 and 108, and insert two electrodes 150*a* and 150*b* of the indicator 140 into two openings in the same row on the isometric spring force selector 52. For example as illustrated in FIG. 5A, the user first chooses a lower level of the spring force and inserts two electrodes 150*a* and 150*b* of the indicator 140 into the paired openings 56*a* and 56*b* which are placed at a higher position of the isometric spring force selector 52. Then the user uses his right and left hand to grip the respective loop ends 15 and 19 of the first and second upper grip 10 and 16. Meanwhile the user uses his foot to stand on the loop end 32 of the lower grip 30 which is affixed to the bottom end 100 of the "U" shaped force selection member 90. The user then can start to exercise his body muscles by pulling two upper grips 10 and 16 upward into a higher vertical position, wherein the grips are linked to the cable or string 22 which is connected to the pulley 102. This results in raising a vertical position of the exercise device body 38 by the user to raising the position of the pulley 102, so as to raise the vertical position of the bottom rim 44 and 114 of the respective top and bottom cover 40 and 108. In accordance with these physical conditions, the coil resistance spring 84 inside of the device body 38 is compressed to have a reduced length due to the upward pulling force from the user which is applied to the bottom end 88 of the coil resistance spring 84, through the bottom side of the coil spring housing including part of the bottom rims 44 and 114 of the respective top and bottom covers 40 and 108, wherein the physical conditions also require that the bottom end 100 of the "U" shaped force selection member 90 is placed at a fixed position, and the top end 86 of the coil spring 84 is locked by the top short transverse left end 92 and transverse right member 96. Therefore the transverse force selection member 96 embraced with the "U" shaped electrical contacting member 98 is relatively slid downwardly inside of the middle flat channel 82 of the isometric spring force selector 52, in accordance with the reduction of the coil spring length. The user will continuously pull the device body 38 upwardly until the bottom arm 98*b* of the electrical contracting member 98 contacts both the first and second electrodes 150*a* and 150*b* of the electronic light or sound indicator 140 which competes the electronic circuit so that a visual or audible signal is generated. At this moment, the integrated electronic device 144 is activated so that it drives the electronic light component to emit a light or the electronic sound component to emit a sound, so that the user is informed from the signal of the light or sound that his muscles are exerting the desired isometric force to reach the level of the spring force which the user has chosen. In accordance with the above illustrated physical conditions, the "U" shaped bottom connecting member 100 of the spring force selection member 90 incorporated with the resistance force spring 84 is at a vertical position "A", while the bottom end side rim 114 of the device body bottom cover 108 is raised to a position "B", and the reduction of the spring length is indicated as "H1" in FIG. 5A.

It will be appreciated that in this situation the user can choose to maintain the positions for continuously isometrically exercising the user's muscles to exert forces to balance the resistance force of the spring so that a continuous visual or audible signal is emitted from the indicator 140 to advise the user that the user is maintaining the desired isometric tension force. If the user lessens his force so that the desired isometric force is not applied by the user, the electrical contacting member 98 moves away form the electrodes 150*a* and 150*b* and thereby breaks the circuit and the visual or audible signal is terminated. The user then knows that the user is not applying the required isometric force to exercise the user's muscles at the desired level. Therefore, the present invention assures that the user will always maintain the desired isometric force over the desired time and will not inadvertently lessen the force and not receive the full benefit of the isometric exercise. If the force is reduced, then the resistance force spring 84 will expend back to its original position inside of the device body 38, which results in a corresponding downward movement of the device body 38 including the isometric spring force selector 52. It will be further appreciated that the downward movement of the isometric spring force selector 38 is equivalent to an upward movement of the "U" shaped spring force selection member 90 including the transverse force selection member 96 embraced with the electrical contacting member 98. Therefore the electrical contact will be lost on the two electrodes 150*a* and 150*b* which makes them at the electrically open state, so that the integrated electronic device 144 will be returned to its standby state. Therefore, the signal of the light or sound of the electronic device 140 will be terminated immediately as soon as the loss of the electrical contact of two electrode 150*a* and 150*b*.

FIG. 5B illustrates another situation wherein the user chooses a higher level of the spring resistance force for the user's exercise so that the user inserts the indicator 140 into the paired openings 60*a* and 60*b* which are located at a lower position on the isometric spring force selector 52, in comparison with the higher position of the paired openings 56*a* and 56*b* shown in FIG. 5A. It will be appreciated that after this selection of the force level, the user will perform the same actions as those illustrated in FIG. 5A, wherein the exercise device 1 will respond accordingly. The user will get an indication of the signal from either the light or sound which makes the user know that his muscles are generating the required isometric resistance force to balance the greater resistance spring force at the level the user has chosen. In that situation, the "U" shaped bottom end 100 is still at the vertical position "A", while the bottom side rim 114 of the device body bottom cover 108 is raised to a higher position "B'", and a reduction of the spring length is indicated as "H2" in FIG. 5B. The length "H2" is longer than the length "H1" in FIG. 5A. Therefore, the longer distance "H2" corresponds a larger reduction of the coil spring length, which corresponds to a greater resistance force from the coil spring which needs a greater muscle force to balance it.

From the above two examples, it will be appreciated that the present invention 1 brings significant advantages through significant improvement to the conventional coil resistance force spring based exercise devices. The significant advantage as well as improvement of the present invention is to provide a device which the user will have a freedom to precisely choose a level of the force load in the user's exercise for his particular needs, since the present invention which employs the isometric spring force selector 52 incorporated with the "U" shaped spring force selection member 90 fully applies the principle of the coil resistance force spring wherein the output force of the coil spring is proportional to a change of the spring length. Therefore, the user can quantitatively choose the level of spring force load in his exercise through simply choosing a position of two openings in the same row on the isometric spring force selector 52.

The significant advantage as well as improvement of the present invention is also from providing the electronic light or sound indicator 140 which serves to assist the user to achieve the user's objective of maintaining a desired isometric pulling force for a given period of time through the indicator providing the signal of the light or sound as the indication that the chosen force level is reached and maintained so that the user can objectively control intensity and total amount of his work out.

It will be appreciated that although the above disclosure of the present invention portable isometric exercise device 1 is comprised of the coil spring 84, it is within the spirit and scope of the present invention to encompass other spring force devices such as an air spring as long as the level of resistance can be adjusted and the signal produced to advise the user that the isometric force is being maintained.

It will also be appreciated that the above examples illustrate applications of the present invention portable isometric exercise device 1 wherein the device body 38 is positioned in a vertical orientation. It is within the spirit and scope of the present invention for the device body 38 to be orientated in any direction when the exercise device 1 is used. For example, the device body 38 can be positioned in a horizontal orientation. In accordance with the position, the user can use one hand to grasp both upper grips and another hand to grasp the lower grip, therefore the user can use the present invention portable isometric exercise device 1 to mainly exercise his arm and chest muscles.

Defined in detail, the present invention is a portable isometric exercise device, comprising: (a) a body having a top cover and a mating bottom cover which define a generally cylindrical interior chamber in one area and a generally rectangular interior chamber in an adjacent area; (b) a coil resistance spring having a top end and bottom end housed in the cylindrical chamber and retaining a "U" shaped spring force selection member having an arcuate lower section which extends below the bottom end of the coil spring and out of the body and a first longitudinal bar adjacent the top of the coil spring and terminating in a first transverse retaining member and a second longitudinal bar terminating in a transverse force selection member adjacent the top of the coil spring and extending in a direction opposite to the first transverse member; (c) an isometric spring force selector being a generally rectangular structure retained within the generally rectangular chamber of the housing and having an interior slot extending through a longitudinal opening in a wall facing the coil spring, a multiplicity of paired force selection resistance level openings positioned in an aligned column on the spring force selector, the top cover having aligned matching openings; (d)

the transverse force selection member partially surrounded by a "U" shaped metal connection member, the force selection member and "U" shaped metal connection member positioned within the slot of the isometric spring force selector so that after the top and bottom covers are joined together, the bottom of the "U" shaped spring force selection member can be pulled to cause the transverse force selection member and "U" shaped metal connection member to be aligned with a given pair of openings; (e) an electronic signal indicator having two metal prongs which extend from a body of the indicator which contains an electronic signal means therein, so that when the two metal prongs are inserted into a respective one of the pair of openings, the prongs come in contact with the "U" shaped metal connection member to close an electric circuit and cause a signal to be continuously emitted and when the "U" shaped metal connection member moves away from the area into which the two metal prongs have been inserted, the signal is terminated; and (f) a first gripping means looped/chained to the arcuate lower section of the "U" shaped spring force selection member and a second gripping means affixed to the body at a location remote from the first gripping means, body parts used to pull the two gripping means apart so that the transverse force selection member and "U" shaped metal connection member come in contact with the selected location where the two metal prongs are located and a continuous signal is emitted to advise that the given level of isometric resistance force is achieved and maintained and if the force is reduced, the transverse force selection member and "U" shaped metal connection member move away from the prongs and the signal is terminated.

Defined more broadly, the present invention is a portable isometric exercise device, comprising: (a) a body having a top cover and a mating bottom cover which define a generally cylindrical interior chamber in one area and an adjacent chamber in an adjacent area; (b) a coil resistance spring having a top end and bottom end housed in the cylindrical chamber and retaining a spring force selection member having an arcuate lower section which extends below the bottom end of the coil spring and out of the body and means to retain the spring force selection member within the coil spring, the spring force selection member having a transverse force selection member adjacent the top of the coil spring and extending in a direction transverse to the length of the coil spring; (c) an isometric spring force selector having a housing retained within the adjacent interior chamber of the body and having an interior slot extending through a longitudinal opening in a wall facing the coil spring, a multiplicity of force selection resistance level openings positioned with at least one opening in a row and the openings positioned in an aligned column on the spring force selector, the top cover having aligned matching openings; (d) the transverse force selection member partially surrounded by a metal connection member, the force selection member and metal connection member positioned within the slot of the isometric spring force selector so that after the top and bottom covers are joined together, the lower arcuate surface of the spring force selection member can be pulled to cause the transverse force selection member and metal connection member to be aligned with a selected opening; (e) an electronic signal indicator having at least one metal prong which extends from a body of the indicator which contains an electronic signal means therein, so that when the at least one metal prong is inserted into a respective one of the aligned openings, the prong comes in contact with the metal connection member to close an electric circuit and cause a signal to be continuously emitted and when the metal connection member moves away from the area into which the at least one metal prong was inserted, the signal is terminated; and (f) a first gripping means looped/chained to the arcuate lower section of the spring force selection member and a second gripping means affixed to the body at a location remote from the first gripping means, body parts used to pull the two gripping means apart so that the transverse force selection member and metal connector come in contact with the selected location where the at least one metal prong is located and a continuous signal is emitted to advise that the given level of isometric resistance force is achieved and maintained and if the force is reduced, the transverse force selection member and metal connector move away from the at least one prong and the signal is terminated.

Defined even more broadly, the present invention is a portable isometric exercise device, comprising: (a) a body having a top cover and a mating bottom cover which define a generally cylindrical interior chamber in one area and an adjacent chamber in an adjacent area; (b) a coil resistance spring having a top end and bottom end housed in the cylindrical chamber and retaining a spring force selection member having a lower section which extends below the bottom end of the coil spring and out of the body and means to retain the spring force selection member within the coil spring, the spring force selection member having a transverse force selection member adjacent the top of the coil spring and extending in a direction transverse to the length of the coil spring; (c) an isometric spring force selector retained within the adjacent interior chamber of the body and having means to slidably retain the transverse force selection member, a multiplicity of force selection resistance level openings positioned with at least one opening in a row and the openings positioned in an aligned column on the spring force selector, the top cover having aligned matching openings; (d) the transverse force selection member partially surrounded by a metal connection member, the force selection member and metal connection member slidably positioned within the isometric spring force selector so that after the top and bottom covers are joined together, the lower section of the spring force selection member can be pulled to cause the transverse force selection member and metal connection member to be aligned with a selected opening; (e) an electronic signal indicator having at least one metal prong which extends from a body of the indicator which contains an electronic signal means therein, so that when the at least one metal prong is inserted into a respective one of the aligned openings, the prong comes in contact with the metal connection member to close an electric circuit and cause a signal to be continuously emitted and when the metal connection member moves away from the area into which the at least one metal prong was inserted, the signal is terminated; and (f) a first gripping means affixed to the arcuate lower section of the spring force selection member and a second gripping means looped/chained to the body at a location remote from the first gripping means, body parts used to pull the two gripping means apart so that the transverse force selection member and metal connector come in contact with the selected location where the at least one metal prong is located and a continuous signal is emitted to advise that the given level of isometric resistance force is achieved and maintained and if the force is reduced, the transverse force selection member and metal connector move away from the at least one prong and the signal is terminated.

Defined most broadly, the present invention is a portable isometric exercise device, comprising: (a) a body having a top cover and a mating bottom cover which define a first interior chamber in one area and a second adjacent chamber in an adjacent area; (b) a coil resistance force means having a top end and bottom end housed in the first interior chamber and retaining a force selection member having a lower section which extends below the bottom end of the resistance force means and out of the body and means to retain the force selection member within the resistance force means, the force selection member having a transverse force selection member adjacent the top of the resistance force means and extending in a direction transverse to the length of the resistance force means; (c) an isometric force selector retained within the second adjacent interior chamber of the body and having means to slidably retain the transverse force selection member, a multiplicity of force selection resistance level openings positioned with at least one opening in a row and the openings positioned in an aligned column on the force selector, the top cover having aligned matching openings; (d) the transverse force selection member partially surrounded by an electrical connection member, the force selection member and electrical connection member slidably positioned within the isometric force selector so that after the top and bottom covers are joined together, the lower section of the force selection member can be pulled to cause the transverse force selection member and electrical connection member to be aligned with a selected opening; (e) an electronic signal indicator having at least one electrical connector which extends from a body of the indicator which contains an electronic signal means therein, so that when the at least one electrical connector is inserted into a respective one of the aligned openings, the electrical connector comes in contact with the electrical connection member to close an electric circuit and cause a signal to be continuously emitted and when the electrical connection member moves away from the area into which the at least one electrical connector was inserted, the signal is terminated; and (f) a first gripping means looped/chained to the lower section of the force selection member and a second gripping means affixed to the body at a location remote from the first gripping means, body parts used to pull the two gripping means apart so that the transverse force selection member and electrical connection member come in contact with the selected location where the at least one electrical connector is located and a continuous signal is emitted to advise that the given level of isometric resistance force is achieved and maintained and if the force is reduced, the transverse force selection member and electrical connection member move away from the at least one electrical connector and the signal is terminated.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A method of exercising, the method comprising the steps of:

a. providing an exercise device having a force level indicator that indicates when at least first and second force levels have been reached, wherein the exercise device further includes an assembly that includes at least a first member, b. applying a force to the assembly that is equal to the first force level, wherein the force level indicator indicates that the first force level has been reached, c. maintaining the first force level, whereby the force level indicator continues to indicate, d. applying a force to the assembly that is equal to the second force level, wherein the force level indicator indicates that the second force level has been reached, and e. maintaining the second force level, whereby the force level indicator continues to indicate.

2. The method of claim 1, wherein the assembly comprises a grip assembly, and wherein the exercise device includes a spring operatively connected to the grip assembly, and wherein the first force level is determined by the amount of force necessary to compress or tension the spring a predetermined first distance, and wherein the second force level is determined by the amount of force necessary to compress or tension the spring a predetermined second distance.

3. The method of claim 1 wherein the force level indicator includes either or both of a visual signal or an audible signal that is activated when the desired force level is reached and is deactivated if the desired force level is not maintained.

4. The method of claim 1 further including the step of selecting the first force level before step (b) and selecting the second force level before step (d).

5. The method of claim 1 wherein the assembly includes a second member.

6. The method of claim 5 further comprising the step of moving the first and second members relative to one another while maintaining the first force level.

7. A method of exercising, the method comprising the steps of:

a. providing an exercise device having an assembly operatively connected to a biasing device, b. applying a first level of force to the biasing device using the assembly, c. performing a first isometric exercise with the assembly while maintaining the first level of force, d. performing a first kinetic exercise using the assembly while maintaining the first level of force, e. applying a second level of force to the biasing device using the assembly, f. performing a second isometric exercise with the assembly while maintaining the second level of force, and g. performing a second kinetic exercise using the assembly while maintaining the second level of force, wherein the second force level is greater than the first force level.

8. The method of claim 7 wherein the assembly includes a pulley member that is operatively connected to the biasing device, wherein the performance of steps (b) and (e) cause the pulley member to move linearly, and wherein the performance of steps (d) and (g) cause the pulley member to move rotationally.

9. The method of claim 7 wherein the assembly includes first and second members, wherein the first and second members move in substantially the same direction during the performance of steps (b) and (e), and wherein the first and second members move in substantially opposite directions during the performance of steps (d) and (g).

10. The method of claim 7 wherein a visual or audible indicator is activated when the first force level is applied and wherein the indicator remains activated when the first force level is maintained.

* * * * *